US005290181A

United States Patent [19]

Bixler et al.

[11] Patent Number: 5,290,181

[45] Date of Patent: Mar. 1, 1994

[54] LOW INSERTION FORCE MATING ELECTRICAL CONTACT STRUCTURE

[75] Inventors: Craig A. Bixler, Elmhurst; Frank A. Harwath, Downers Grove; Richard A. Nelson, Glen Ellyn; Michael O'Sullivan, Willowbrook, all of Ill.

[73] Assignee: Molex Incorporated, Lisle, Ill.

[21] Appl. No.: 10,951

[22] Filed: Jan. 29, 1993

[51] Int. Cl.[5] ..... H01R 11/22

[52] U.S. Cl. ..... 439/856; 439/692

[58] Field of Search ..... 439/851-857, 439/861, 289-293, 842, 843, 692

[56] References Cited

U.S. PATENT DOCUMENTS

| | | | |
|---|---|---|---|
| 3,011,143 | 11/1961 | Dean | 439/291 |
| 3,411,127 | 11/1968 | Adams | 439/290 |
| 3,414,865 | 12/1968 | Olsson | 439/290 |
| 3,732,525 | 5/1973 | Henschen et al. | 439/291 |
| 4,416,504 | 11/1983 | Sochor | 339/252 P |
| 4,740,180 | 4/1988 | Harwath et al. | 439/856 |
| 4,820,182 | 4/1989 | Harwath et al. | 439/290 |
| 4,887,976 | 12/1989 | Bennett et al. | 439/492 |

*Primary Examiner*—David L. Pirlot

*Attorney, Agent, or Firm*—Stacey E. Caldwell

[57] ABSTRACT

An electrical connector assembly having a low insertion force, high normal force mating contact structure comprising a male terminal and a female terminal. The contact portions of the female terminal are adapted to electrically engage the lead-in portion of the male terminal as the male terminal is inserted into the mouth between the contact portion of the female terminal. The lead-in portion of the male terminal is split and defines a pair of diverging beams extending forwardly and angled outwardly from the final contact area. The beams have inwardly facing, laterally offset, opposing camming portions adapted to engage and increasingly deflect the contact portions of the spring arms of the female terminal as the male terminal is moved from an initial position to a final position wherein the female contact portions are in engagement with the final contact area of the male terminal. The normal forces between the contact portions of the spring arms and the corresponding camming portion gradually increase until the final mated position is achieved. The split male configuration allows for increased terminal mating length and adjustment of the wiping action of the contacts as desired.

8 Claims, 3 Drawing Sheets

A
12
18
10
14
16
24a
28
20
26a
26
24
22

12
18
10
24a
24
22
26a
26
16
20

B
34
38
36
24a
24b
40
28
40a
24
38a
20
26b
26a
32
22

34
C
36
24
30
50
C
20
26
40
32
22
52

LOW INSERTION FORCE MATING ELECTRICAL CONTACT STRUCTURE

FIELD OF THE INVENTION

This invention generally relates to the art of electrical connectors and, more particularly, to a low insertion force, high contact normal force, mating male and female electrical contact structure and to electrical connectors incorporating them.

BACKGROUND OF THE INVENTION

Various single and dual spring arm female contact electrical terminals have been provided in the past for making electrical contact with male terminals such as pins, blades, edge card contact pads and the like. In order to establish satisfactory electrical connection, one of the terminals must exert sufficient pressure on the other resulting in a minimum contact normal force being exerted when the terminals are in a final mated position. However, this pressure causes frictional drag during insertion and removal, therefore, the male terminal must be inserted into the female terminal with sufficient force to overcome the resistance to insertion presented by the female terminal. In addition, the insertion force of the contact structure must include a lifting component which represents the force required to lift or spread the female contact portions apart to permit insertion of the male terminal into the female terminal as well as the horizontal frictional component which is a result of the female contact portions wiping against the male terminal during the insertion. As a result, in multicircuit arrangements including a large number of female terminals mounted in a connector adapted to mate with a male connector having a correspondingly large number of male terminals, the individual insertion forces associated with each pair of terminals combine so that the overall insertion force required to mate the male and female connectors may be extremely high.

Earlier efforts to provide an electrical contact structure characterized by reduced insertion force have generally included modifying the female terminal or contacts. In U.S. Pat. No. 4,175,821, for example, a female terminal is disclosed which includes a dual opposed spring arm contact member wherein the contact portions of the opposed arms are axially offset from one another in the longitudinal direction. As a male pin contact is inserted between the female spring arms, the pin engages the first spring arm on the female terminal and lifts it out of the way, before contacting the second spring arm and moving that contact out of the way. As a result, a lower peak insertion force is achieved because the male terminal lifts only one female spring arm at a time.

Another modified low insertion force female terminal is disclosed in U.S. Pat. No. 4,607,907. The female contact in this patent is a stamped and formed terminal which includes a rearward box-like member from which extend cantilevered spring arms having contact portions at their free ends. The contact portions are axially longitudinally offset similar to the contact portions in the aforementioned patent, but, in addition, they are configured so that they overshoot the midline of the insertion region which permits lower spring rates to be used, both factors of which contribute to an overall low insertion force female terminal.

Subsequent efforts to provide an electrical contact structure characterized by reduced insertion force have included modifying the male terminal contacts. For instance, in U.S. Pat. No. 4,740,180, dated Apr. 26, 1988 and assigned to the assignee of this invention, a low insertion force contact structure is disclosed including a male terminal having a twisted lead-in portion with at least one surface adapted to engage at least one contact of a female terminal. Specifically, during insertion the twisted lead-in portion of the male terminal is effective to gradually cam outwardly contact portions of a pair of spring arms of the female terminal from an initial position to a final mated position to provide a low overall insertion force and at the same time provide a high contact normal force between the female and male terminals. The mating electrical contact structure and camming profile disclosed in this patent have proven effective to provide a highly reliable, low insertion force contact interface. However, the design is not easily adaptable for miniaturization beyond a certain point, i.e. for reducing individual terminal size in order to produce denser arrays of terminals in increasingly smaller packages. Furthermore, the solid lead-in portion of the male terminal has limited mating depth and does not generally permit applications in which sequential or staggered mating may be required. Although these limitations are not critical in many applications, they may provide potential problems in some specific connector applications.

Therefore, the present invention is directed to further improvements in electrical contact structures characterized by reduced insertion forces, particularly of the type shown in U.S. Pat. No. 4,740,180.

SUMMARY OF THE INVENTION

An object, therefore, of the invention is to provide a new and improved low insertion force, high contact normal force mating male and female electrical contact structure of the character described.

In the exemplary embodiment of the invention, a mating electrical contact structure is disclosed including a male terminal and a female terminal. The male terminal is an elongate conductor including a final contact area joining a forwardly extending lead-in portion. The female terminal includes dual-cantilever spring arms having spaced-apart opposing contact portions which define a lead-in mouth therebetween. Generally, the contact portions of the female terminal are adapted to electrically engage the lead-in portion of the male terminal as the male terminal is inserted into the mouth between the spaced-apart portions of the female terminal.

The invention contemplates an improved mating contact structure wherein the cross-sectional camming profile of the lead-in portion of the prior art male terminal is retained, thus maintaining a low insertion force mating male and female electrical contact structure. However, the lead-in portion of the male terminal is designed so as to exhibit virtually no side vector force components, to reduce the possibility of contact stubbing, to increase individual contact wipe, and to allow for high density, reduced pitch configurations. Specifically the lead-in portion of the male terminal of the invention is split and defines a pair of symmetrical diverging beams extending forwardly and angled transversely outwardly of the final contact area of the male terminal. The beams have inwardly facing, laterally offset, opposing camming portions adapted to increasingly deflect the contact portions of the spring arms of the female terminal as the male terminal is moved from an initial position to a final mated position wherein the female contact portions are in engagement with the final contact area of the male terminal. Therefore, normal forces between the contact portions of the spring arms and the corresponding camming portions gradually increase until the final mated position is achieved.

As disclosed herein, the diverging beams of the male terminal exhibit force components against the spring arms of the female terminal only in directions opposite the mating direction and perpendicular to the mating plane of the terminals, and therefore exhibit virtually no side vector force components. The final contact area of the male terminal is generally rectangular in cross-section with opposing sides thereof being slidably engageable by the contact portions of the spring arms of the female terminal. The opposing camming portions of the diverging beams, generally, are continuations of the opposite planar sides of the final contact area of the male terminal. The beams have chamfered tips to reduce the chance of stubbing upon mating of the female and male terminals. The contact portions of the spring arms of the female terminal are rounded to further facilitate easy mating between the terminals. Furthermore, the split male configuration allows for increased terminal mating length whereby the mating depth of the male and female contacts is easily varied by changing the camming profile, and consequent wiping action of the contacts can be easily adjusted as desired. Finally, the relatively uncomplicated structure of the male terminal is easily manufacturable by stamping and forming and may be miniaturized so as to be operative on closer center spacings in the packaging arrays of today's high density connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 1A, 2, 2A:
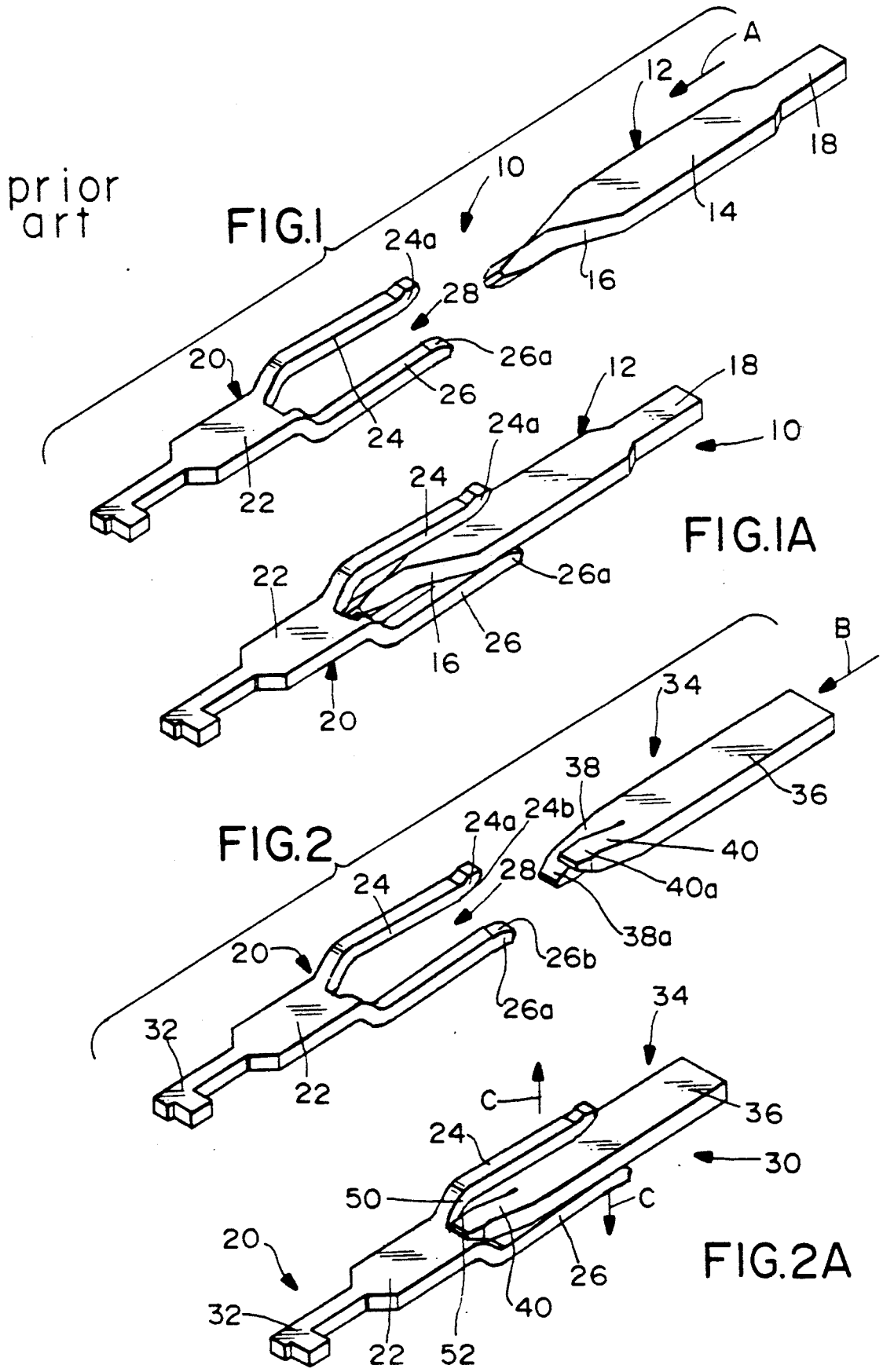
prior art FIG.1
FIG. 1 is a perspective view of a mating electrical male and female contact structure of the prior art, particularly as disclosed in U.S. Pat. No. 4,740,180.
FIG. 1A is a perspective view of the male and female contact structure of FIG. 1, in mated condition.
FIG. 2 is a perspective view of a mating electrical male and female contact structure of the invention.
FIG. 2A is a perspective view of the male and female contact structure of FIG. 2, in mated condition.
Figure 3:
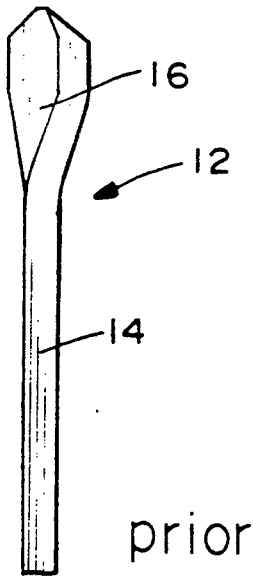
prior art FIG.3
FIG. 3 is a fragmented a side elevational view of the male terminal of FIGS. 1 and 1A.

Referring to the drawings in greater detail, and first to FIGS. 1 and 3, a low insertion force mating electrical contact structure, generally designated 10, of the prior art is shown, particularly a contact structure similar to that disclosed in U.S. Pat. No. 4,740,180. The contact structure includes a male terminal, generally designated 12, having a final contact area 14 and a forwardly extending lead-in portion 16 which has a gradual twisted cross-section relative to final contact area 14. A rear portion 18 is provided, such as a solder tail or contact pin, adapted to engage an external circuit member rearwardly of final contact area 14. The male terminal is formed by stamping sheet metal stock of desired thickness, and thereafter coining and twisting the lead-in portion 16 to impart the desired helical or twisted configuration as shown.

Figure 5:
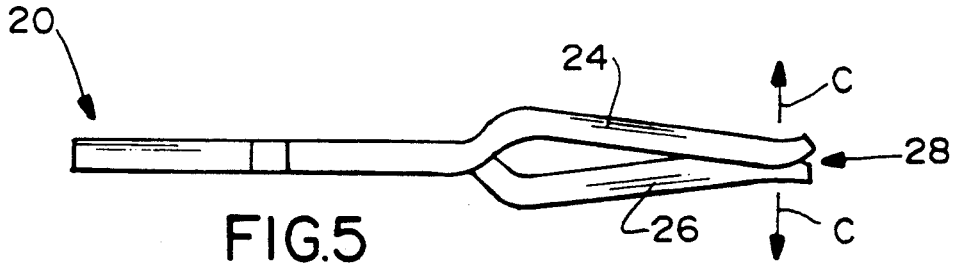
FIG. 5 is a fragmented side elevational view of the female terminal of the contact structure of FIGS. 1 and 2.

Mating electrical contact structure 10 further includes a female terminal, generally designated 20, adapted to mateably receive male terminal 12. The female terminal, shown in detail in FIGS. 1, 1A and 5, is an integral metallic stamping including a generally rectangular base portion 22 and a pair of laterally offset, vertically opposing cantilevered spring arms 24 and 26 extending forwardly from opposite sides or edges of base portion 22. Spring arms 24 and 26 are formed so that they extend first away from each other at base portion 22 and thereafter toward each other. Free ends 24*a* and 26*a* of the spring arms are adapted for engaging twisted lead-in portion 16 of male terminal 12 during mating of the terminals, whereby the twisted portion gradually cams outwardly or deflects the spring arms from an initial position to a final mated position. The dual opposing spring arm configuration of female terminal 20 defines an insertion mouth, as generally indicated at 28, extending between free ends 24*a* and 26*a* and into which male terminal 12 is inserted in the direction of arrow "A".

FIG. 1A shows male terminal 12 and female terminal 20 of the prior art of FIG. 1, in fully mated condition. During mating, twisted lead-in portion 16 of male terminal 12 is effective to engage free ends 24*a* and 26*a* of spring arms 24 and 26, respectively, to gradually cam outwardly or deflect the spring arms and gradually increase the insertion forces until the spring arms wipe along final contact area 14 of male terminal 12 to achieve their final mated position as shown in FIG. 1A. It can be understood from the above description of the prior art shown in FIGS. 1, 1A and 3, that the twisted lead-in portion 16 of male terminal 12 prevents extended mating length of the terminals which may become necessary in applications where tolerance may prevent adequate wipe, or when longer ground pins are required for sequential mating. Furthermore, manufacturing and dimensional considerations of the twisted solid construction of the male prevents a mere downsizing of the contact mating structure to achieve closer spacing, thus obviating its use miniature, dense array connectors.

Referring now to FIGS. 2 and 2A, the invention is incorporated in a mating contact structure, generally designated 30, similar to contact structure 10, in that female terminal 20 is substantially identical to that described above in relation to FIGS. 1 and 1A. Therefore, further details of the female terminal will not be repeated, except to state that free ends 24a and 26a of spring arms 24 and 26, respectively, have rounded contact portions 24b and 26b, respectively. Of course, this is true also for the construction shown in FIGS. 1 and 1A. In addition, the female terminal has a rear end 32 mountable in a connector housing (not shown) and/or adapted to engage an external circuit member extending rearwardly of base portion 22.

Mating electrical contact structure 30 of the invention includes a male terminal, generally designated 34, insertable into mouth 28 between spring arms 24 and 26 of female terminal 20, in the direction of arrow "B". The male terminal includes a final contact area 36 similar to final contact portion 14 of male terminal 12 (FIG. 1). Male terminal 34 may include a rear tail or pin portion such as rear portion 18 of male terminal 12.

Figure 4:
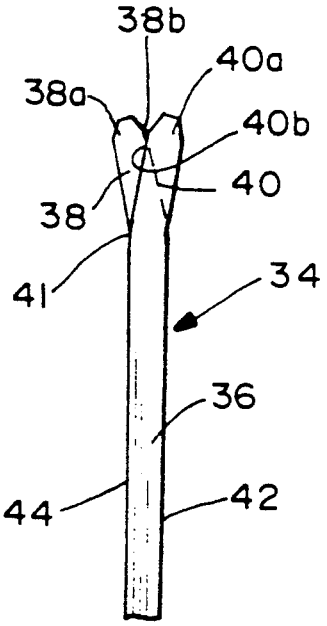
FIG. 4 is a fragmented side elevational view of the male terminal of the contact structure of FIGS. 2 and 2A.

Referring to FIGS. 3 and 4, the invention contemplates that male terminal 34 exhibit the same gradual camming action and resultant low insertion force as the prior art male terminal 12, with advantages not found in the prior art. Therefore, the same mating effect will exist between terminals 20 and 34 as was described with respect to terminals 20 and 12. Specifically, male terminal 34 includes a lead-in portion which is split and defined by a pair of laterally offset, symmetrical diverging beams 38 and 40 which extend forwardly and are angled transversely outwardly of final contact area 36. The tips of the beams are chamfered, as at 38a and 40a, to reduce the chance of stubbing, i.e. avoiding any interference with spring arms 24 and 26 of female terminal 20.

Referring to FIG. 4 in conjunction with FIG. 2, final contact area 36 of male terminal 24 is generally rectangular in cross-section, as best seen in FIG. 2, to define opposite planar sides 42 and 44 (FIG. 4). Diverging beams 38 and 40 are generally rectangular in cross-section as best seen in FIGS. 2 and 4. This rectangular configuration defines inwardly opposing, laterally offset, symmetrical camming portions 38b and 40b as seen in FIG. 4. In the preferred embodiment camming portion 38b of beam 38 is planar, forming a continuation of planar side 42 of final contact area 36, and camming portion 40b of beam 40 is planar, similarly forming a continuation of opposite planar side 44 of final contact area 36. Transition area 41 is radiused to provide a very gradual passage and consistent increase in contact normal force between the camming portions and the final contact areas, as rounded contact portions 24b and 26b of spring arms 24 and 26, respectively, of female terminal 20, slidingly engage the male terminal, as described below.

More particularly, referring to FIG. 2 in conjunction with FIG. 2A, as male terminal 34 is inserted into female terminal 20, beams 38 and 40, which define the lead-in portion of male terminal 34, initially engage rounded contact portions 24b and 26b of spring arms 24 and 26, respectively. In moving from this initial position to a final position shown in FIG. 2A, contact portions 24b and 26b of the female terminal will respectively slide along planar camming portions 38b and 40b of beams 38 and 40, respectively, through radiused transition area 41, and onto opposite planar sides 42 and 44 of final contact area 36 of male terminal 34, all as best seen in FIG. 4. Beams 38 and 40 of male terminal 34 are effective to gradually cam outwardly or deflect spring arms 24 in opposite directions, as indicated by arrows "C" (FIGS. 2A and 5), and the force vectors exerted against the spring arms exist only in the directions opposite the mating direction and perpendicular to the mating plane, i.e. in a direction opposite arrow "B" in FIG. 2, and in the direction of arrow "C" in FIG. 2A. The chamfered lead-in areas located at the free end of diverging beams 38 and 40 are mated "head-on" with spring arms 24 and 26 and therefore exhibit no stubbing upon insertion. Furthermore, the split configuration of both terminals allows for variable mating lengths, either within the same connector when sequential mating is desirable, or in different applications, where tolerance and other dimensional considerations may necessitate increased wiping action.

Figure 6:
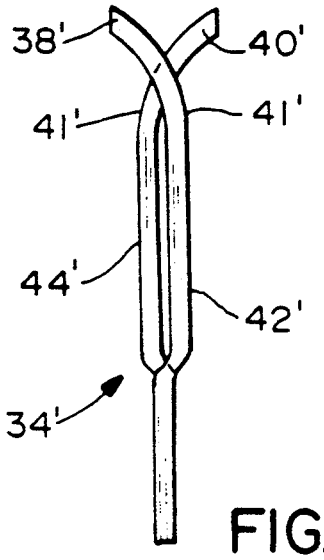
FIG. 6 is a fragmented side elevational view of a second embodiment of the subject invention.
Figure 7:
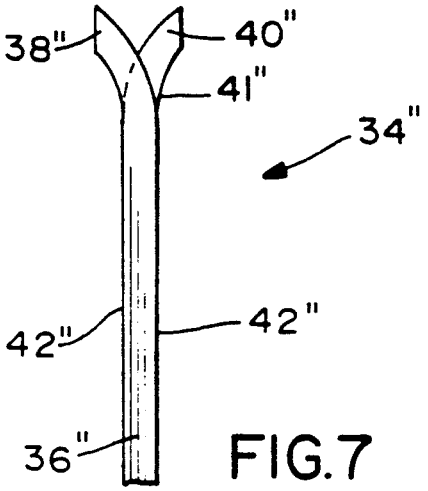
FIG. 7 is a fragmented side elevational view of a third embodiment of the subject invention.

FIGS. 6 and 7 show alternate designs of a male terminal having diverging split beams, which exhibit an alternate gradual camming profile in a generally radiused configuration, as opposed to planar with like reference numbers, in primes, designating like elements, as described above. FIG. 6 is a cost-saving configuration in which the material thickness is approximately half of that exhibited in the embodiments shown in FIGS. 4 and 7.

Figure 8:
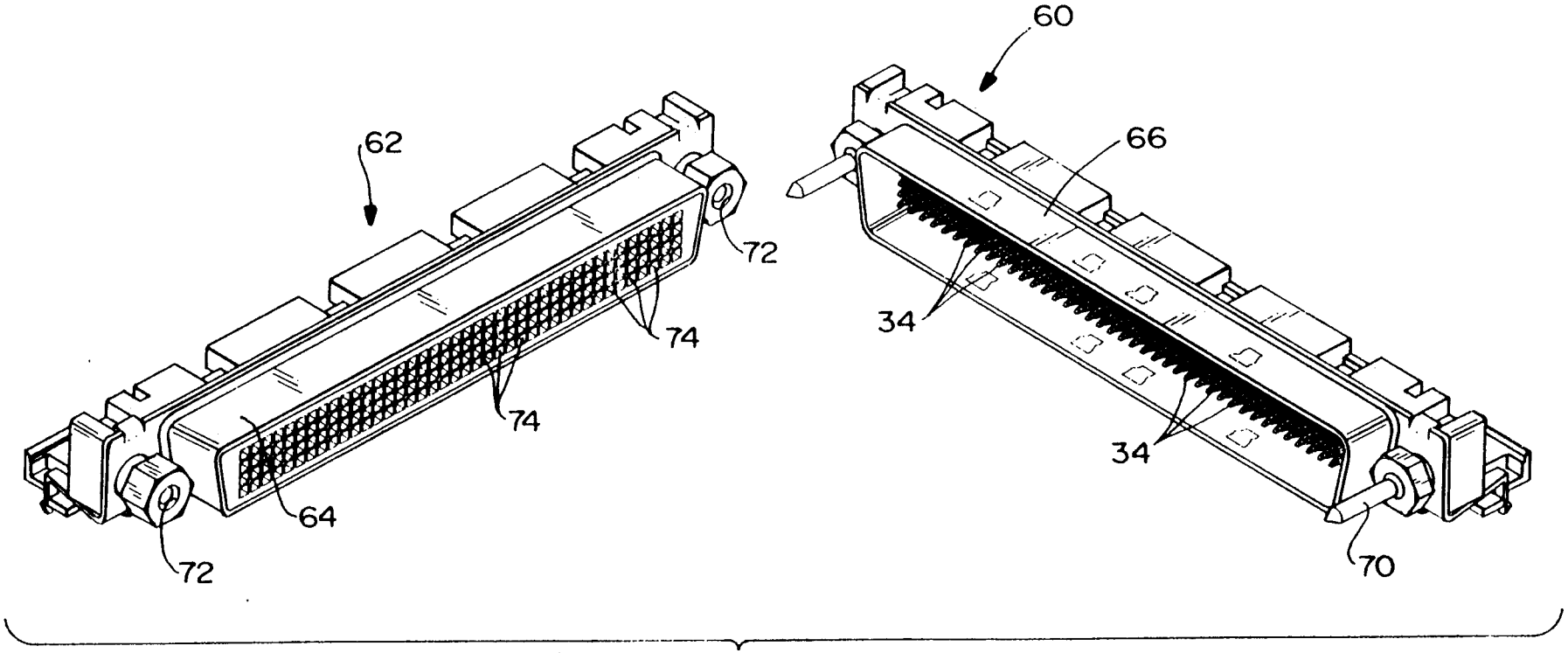
FIG. 8 is a perspective view of a plug and receptacle connector assembly applicable for use with the invention.

Lastly, FIG. 8 shows an electrical connector assembly, generally designated 60, which is applicable for use with the electrical contact structure of the invention as described above in relation to FIGS. 1–7. Of course, the invention is applicable for use with a wide variety of connector assemblies. In the assembly of FIG. 8, a male connector, generally designated 62, includes a plug portion 64 for insertion into a receptacle portion 66 of a female connector, generally designated 68. Connectors 62 and 68 are elongated for mounting a high density array of male terminals 34 (FIGS. 2, 2A and 4) and female terminals 20 (FIGS. 1, 1A and 5) therewithin. For instance, it can be seen that plug portion 64 of connector 62 has four rows of passages 74 extending lengthwise of the connector, with forty passages in each row, for a total 160 passages in the array. The passages are adapted for receiving female terminals 20 within the connector. Each passage 74 is defined by four side walls, which limit the lateral movement of the female terminal spring arms 24 and 26 upon mating of the plug and receptacle connector assemblies. Specifically, 160 female terminals 20 are mounted within the passages, with the mating ends of the terminals, comprising spring arms 24 and 26, facing toward the open mating ends of the passages visible in FIG. 8. The relatively resilient and fragile female terminals 20 are therefore protected from damage and/or deformation upon mating. The relatively rigid male terminals 34 are mounted in receptacle connector 68, each male being received in a passage 74 upon mating of the connector assemblies 60 and 62, that is, four rows of forty male terminals 34 are mounted within connector 68 for mating with the female terminals mounted in connector 62. It is readily apparent that, with such a large number of mating terminals, the insertion forces involved in mating connectors 62 and 68 can be quite large and exemplifies the advantages of the low insertion force terminals of the invention. In addition, high density array of terminals within the connector assembly illustrates how the terminals of the subject invention may be miniaturized, i.e. put on closer center spacing, to achieve such a dense array.

It will be understood that the invention may be embodied in other specific forms without departing from the spirit, or central characteristics thereof. The present examples and embodiments, therefore, are to be considered in all respects as illustrative and not restrictive, and the invention is not to be limited to the details given herein.

We claim:

1. In an electrical connector assembly having a low insertion force, high normal force mating contact structure defined by a male terminal and female terminal, said structure including said male terminal being an elongate conductor having an upper surface and a lower surface, each of said surfaces including a final contact area joining a forwardly extending lead-in portion, said female terminal including spaced-apart dual cantilever spring arms with mutually opposing contact portions defining a conductor-receiving mouth therebetween through which the conductor is slidably received, one contact portion engaging the upper surface and the other contact portion engaging the lower surface between an initial position and a final position wherein the opposing female contact portions are in engagement with the final contact area of the male terminal, whereby, when the contact structure is moved from the initial position to the final position, each of the forwardly extending lead-in portions of the male terminal is effective to gradually and uniformly deflect a respective one of the contact portions of the spring arms, causing the normal force between the contact portions of the spring arm and the upper and lower surfaces of the male terminal to gradually increase, wherein the improvement in said contact structure comprises:

said lead-in portion of said male terminal having a pair of diverging, non-parallel generally non-deflecting split beams, including inwardly facing, laterally offset, opposing camming portions adapted to initially engage and gradually deflect said contact portions as the contact structure is moved toward its final position whereby the gradual and uniform deflection of the contact portions of the spring arms results in a minimal insertion force mating contact structure, and the gradual increase in normal force results in a high contact normal force between the male and female terminals, and whereby greater wiping action over a greater length of the conductor is achieved.

2. In an electrical connector assembly as set forth in claim 1, wherein said diverging beams of the male terminal are generally rectangular in cross-section with the opposing camming portions thereof being generally curved.

3. An electrical connector assembly as set forth in claim 1, further comprising:

a plug connector and a receptacle connector, the plug connector including a dielectric plug housing having a forwardly-extending mating face and a rearward terminating face, with a plurality of terminal-receiving passages formed therethrough, each passage being defined by four side walls and having a female terminal mounted therewithin, the female terminal being positioned so that the contact portions of the spring arms are located rearward of the mating face and rearward of the opening of the terminal-receiving passage proximate the mating face, the receptacle connector including a dielectric receptacle housing with a plurality of male terminals mounted therein each adapted to be received in a corresponding one of the terminal-receiving passages of the plug connector, whereby, upon receipt of the male terminal in a corresponding terminal-receiving passage, the female terminal is protected from damage by the four side walls of the plug connector housing, and a low overall mating force between the plug connector and the receptacle connector is achieved.

4. An electrical connector assembly as set forth in claim 1, wherein said diverging beams of the male terminal are generally rectangular in cross-section with the opposing camming portions thereof being generally planar.

5. In an electrical connector assembly as set forth in claim 4, wherein the final contact area of the male terminal is generally rectangular in cross-section with opposite planar sides thereof being slidably engageable by the contact portions of the spring arms of the female terminal.

6. In an electrical connector assembly as set forth in claim 5, wherein said opposing camming portions of the beams generally comprise continuations of the opposite planar sides of the final contact area.

7. In an electrical connector assembly as set forth in claim 6, wherein said beams have chamfered tips to prevent stubbing of the female terminal upon mating.

8. A low insertion force, high normal force mating electrical contact structure comprising:

a male terminal and a female terminal;

said male terminal being an elongate conductor having a first surface and a second surface, each of said surfaces including a final contact area joining a split lead-in portion, said split lead-in portion having a pair of diverging, non-parallel generally non-deflecting split beams extending forwardly from the final contact area with inwardly facing, laterally offset, opposing camming portions;

said female terminal including dual spaced-apart cantilever spring arms with laterally offset, mutually opposing contact portions defining a conductor-receiving mouth therebetween through which the conductor is slidably received, one contact portion adapted to engage the first surface of the conductor, and the other contact portion adapted to engage the second surface of the conductor;

said camming portions of said diverging beams of the male terminal adapted to gradually and uniformly deflect the contact portions of the spring arms of the female terminal as the male terminal is inserted into the conductor-receiving mouth and moved between an initial position and a final mated position where the female terminal contact portions are in engagement with the final contact area of the male terminal;

whereby the gradual and uniform deflection of the spring arms results in a low insertion force, and the normal force between the contact portion of the spring arms of the female terminal and the camming portions of the male terminal gradually and uniformly increases as the male terminal is inserted into the female terminal until the final mated position is achieved and a high contact normal force is provided therebetween, and whereby greater wiping action over a greater length of the conductor is achieved.

* * * * *